US008487466B2

(12) United States Patent
Schroeder

(10) Patent No.: US 8,487,466 B2
(45) Date of Patent: Jul. 16, 2013

(54) TURBO-MACHINE HAVING AT LEAST TWO COUNTER-ROTATABLE ROTORS AND HAVING MECHANICAL TORQUE COMPENSATION

(75) Inventor: Dierk Schroeder, Selent (DE)

(73) Assignee: Siemens Aktiengesellschaft, Munich (DE)

( * ) Notice: Subject to any disclaimer, the term of this patent is extended or adjusted under 35 U.S.C. 154(b) by 288 days.

(21) Appl. No.: 12/994,470

(22) PCT Filed: May 20, 2009

(86) PCT No.: PCT/EP2009/056156

§ 371 (c)(1),
(2), (4) Date: Nov. 24, 2010

(87) PCT Pub. No.: WO2009/144164

PCT Pub. Date: Dec. 3, 2009

(65) Prior Publication Data

US 2011/0074158 A1 Mar. 31, 2011

(30) Foreign Application Priority Data

May 27, 2008 (DE) ..... 10 2008 025 210

(51) Int. Cl.
*B63H 1/14* (2006.01)

(52) U.S. Cl.
USPC ..... 290/52; 415/60

(58) Field of Classification Search
USPC ..... 415/60
See application file for complete search history.

(56) References Cited

U.S. PATENT DOCUMENTS 2,509,442 A 5/1950 Matheisel
4,508,986 A * 4/1985 Vandamme ..... 310/67 R (Continued)

FOREIGN PATENT DOCUMENTS

CH 673445 A5 3/1990
DE 19717175 A1 10/1998

(Continued)

OTHER PUBLICATIONS

German priority document DE 10 2008 025 210.7 filed May 27, 2008 not yet published.

*Primary Examiner* — Tulsidas C Patel
*Assistant Examiner* — Sean Gugger
(74) *Attorney, Agent, or Firm* — Harness, Dickey & Pierce, P.L.C.

(57) ABSTRACT

A turbo-machine includes at least two rotors which are mounted so as to be rotatable in opposite directions relative to one another about a rotational axis and on which are arranged blades or vanes, having a rotatably mounted machine shaft and having a drive mechanism which connects the machine shaft to the at least two rotors and which converts a rotational movement of the machine shaft into rotational movements of the rotors in opposite directions relative to one another or vice versa. In at least one embodiment, the turbo-machine is designed to utilize the hydrodynamic advantages of counter-rotating rotors yet at the same time have comparatively low mechanical complexity and component density and therefore increased reliability. This is possible according to at least one embodiment of the invention in that the turbo-machine has a housing which forms a duct for a flow of a fluid, wherein the rotors are arranged in series in the duct in the flow direction of the fluid, the machine shaft and the rotors are of annular design and are rotatably mounted in the housing, and wherein the annular rotors have in each case a ring inner side and a ring outer side, wherein the blades or vanes are arranged on the ring inner side.

22 Claims, 3 Drawing Sheets

U.S. PATENT DOCUMENTS

| | | | | |
|---|---|---|---|---|
| 4,604,032 | A * | 8/1986 | Brandt et al. | 416/128 |
| 5,289,068 | A | 2/1994 | Calfo | |
| 5,722,864 | A | 3/1998 | Andiarena | |
| 6,220,906 | B1 | 4/2001 | Dubois | |
| 2007/0126297 | A1 | 6/2007 | De Zwart et al. | |
| 2008/0166934 | A1 * | 7/2008 | Levander et al. | 440/58 |
| 2009/0293795 | A1 | 12/2009 | Schroeder | |

FOREIGN PATENT DOCUMENTS

| | | | |
|---|---|---|---|
| EP | 1739007 | A1 | 1/2007 |
| GB | 1197850 | A | 7/1970 |
| WO | WO 9838085 | A1 | 9/1998 |
| WO | WO 2009/153124 | | 12/2009 |

* cited by examiner

TURBO-MACHINE HAVING AT LEAST TWO COUNTER-ROTATABLE ROTORS AND HAVING MECHANICAL TORQUE COMPENSATION

PRIORITY STATEMENT

This application is the national phase under 35 U.S.C. §371 of PCT International Application No. PCT/EP2009/056156 which has an International filing date of May 20, 2009, which designates the United States of America, and which claims priority on German patent application number DE 10 2008 025 210.7 filed May 27, 2008, the entire contents of each of which are hereby incorporated herein by reference.

FIELD

At least one embodiment of the invention generally relates to a continuous-flow machine.

BACKGROUND

WO 98/38085 A1 discloses a continuous-flow machine having at least two rotors which are mounted such that they can rotate about a rotation axis in mutually opposite directions and on the outer side of which blades or vanes are arranged and having a shaft which is mounted such that it can rotate about the same rotation axis, and having a drive mechanism in the form of a transmission for converting a rotary movement of the shaft to rotary movements of the rotors in mutually opposite directions, that is to say contrarotation, and/or vice versa. In this case, the shaft runs along the rotation axis of the rotors and through it.

The continuous-flow machine can be used particularly advantageously for a marine-vessel propulsion system, for example a POD, in which the blades or vanes of the first rotor form a first propeller, and the blades or vanes of the second rotor form a second propeller, which propellers are driven by the shaft via the propulsion mechanism. The contrarotating second propeller partially redirects the lossy swirl of the propeller outlet flow from the first propeller and converts it to thrust. Mechanical torque compensation such as this improves the efficiency of the marine-vessel propulsion system.

By way of example, the shaft can in this case be driven by an electric motor or an internal combustion engine. The shaft torque is distributed by the drive mechanism between the two propellers, wherein the rotation speed of the shaft is advantageously chosen to be greater than the rotation speed of the two rotors. The drive mechanism therefore acts as a reduction transmission.

This is particularly advantageous in drive systems in which the shaft is driven by an electric motor, because the rotation speed of the electric motor may be higher than without a reduction transmission and, in consequence, the diameter of the electric motor can be reduced.

The continuous-flow machine can also be used particularly advantageously as a turbine, for example for driving a generator. The rotors then drive the shaft, in which case the rotation speeds of the at least two rotors are advantageously less than the rotation speed of the shaft. The drive mechanism then acts as a step-up transmission, as a result of which the torque to be transmitted by the shaft decreases.

The known continuous-flow machine is subject to the problem that the drive mechanism must be accommodated in the relatively small hub. This results in the hub being highly mechanically complex. The dense design furthermore leads to bearing problems and to problems in lubrication of the bearings, which may possibly adversely affect the reliability of the continuous-flow machine. In order to counteract this, the hub would need to be made larger, although this is disadvantageous from the fluid-dynamic point of view, and would destroy the efficiency advantages of the contrarotating arrangement.

SUMMARY

At least one embodiment of the present invention specifies a continuous-flow machine in which the hydrodynamic advantages of a plurality of contrarotating rotors can be used but which is comparatively mechanically uncomplicated, has a comparatively low component density, and is thus more reliable.

In at least one embodiment, a continuous-flow machine is disclosed. In at least one embodiment, a machine arrangement having a continuous-flow machine is disclosed. Particularly advantageous uses of the continuous-flow machine or of the machine arrangement are the subject matter of dependent claims.

A continuous-flow machine according to at least one embodiment of the invention has at least two rotors which are mounted such that they can rotate about a rotation axis in mutually opposite directions and on which blades or vanes are arranged, a machine shaft which is mounted such that it can rotate, and a drive mechanism which connects the machine shaft to the at least two rotors and converts a rotary movement of the machine shaft to rotary movements of the rotors in mutually opposite directions, that is to say contrarotation, or vice versa. A housing forms a channel for a flow of a fluid, wherein the rotors are arranged one behind the other in the channel in the flow direction of the fluid. The machine shaft and the rotors are in this case annular and are mounted in the housing such that they can rotate, wherein the annular rotors each have an annulus inner face and an annulus outer face, and wherein the blades or vanes are each arranged on the annulus inner face of the rotors.

The annular configuration of the shaft and of the rotors, the arrangement of the blades and/or vanes on the annulus inner face of the rotors, and the bearing of the rotors in the housing result in a considerably larger installation space for the drive mechanism between the shaft and the rotors. The larger installation space makes it possible to reduce the mechanical complexity of the drive mechanism and the component density in the machine, and therefore to improve the reliability. In this case, the fluid may be a liquid or a gas.

The annular configuration of the rotor particularly advantageously makes it possible, in the case of the rotors, to dispense with a (central) shaft, that is to say a component which connects the blade or vane ends of a rotor on the side thereof remote from the annular rotor to one another.

Further, the annular configuration of the rotor particularly advantageously makes it possible to dispense with the holders required for this purpose. These holders would have a disturbing effect on a fluid flowing onto the rotors and would decrease the efficiency of a continuous-flow machine. The continuous-flow machine therefore preferably has no component which runs along the rotation axis of the rotors and through them. The lack of a central shaft also has the advantage that foreign bodies' entry into the channel, for example cords or nets, cannot cause any major damage.

In order to achieve particularly uniform power transmission between the machine shaft and the rotors, the drive mechanism is preferably likewise annular.

According to one refinement, whose design is particularly simple, the drive mechanism has a first drive wheel, a plurality of second drive wheels which are arranged distributed in the circumferential direction of the annular drive mechanism and each have a drive shaft which can rotate about a rotation axis and a third drive wheel, wherein the first drive wheel is connected to the machine shaft such that they rotate together, the third drive wheel is connected to a first of the two rotors such that they rotate together, the drive shafts of the second drive wheels are mounted such that they can rotate in the other of the two rotors, and wherein the second drive wheels are coupled to the first drive wheel and to the third drive wheel.

In this case, the first drive wheel and the machine shaft need not necessarily be two separate components and, instead, the two can also form a single component, that is to say the first drive wheel can also be integrated in the machine shaft. This also applies to the second and third drive wheels, and to the respective rotor connected to them.

Particularly space-saving torque transmission, with respect to the circumference, is in this case possible in that the first drive wheel, the second drive wheels and the third drive wheel are each in the form of a bevel gear which is provided with a tooth system, wherein the second drive wheels, both with the first drive wheel and with the third drive wheel, each form a bevel-gear transmission, and wherein the rotation axes of the drive shafts of the second drive wheels are at right angles to the rotation axes of the first drive wheel and of the third drive wheel.

According to one alternative advantageous refinement, the first drive wheel is a cylindrical drive wheel provided with internal teeth and the second drive wheels and the third drive wheel are each cylindrical drive wheels provided with external teeth, wherein the second drive wheels, together with the first drive wheel and the third drive wheel form an epicyclic transmission, and wherein the rotation axes of the drive shafts of the second drive wheels run parallel to the rotation axes of the first drive wheel and of the third drive wheel.

Alternatively, the third drive wheel may also be a cylindrical drive wheel provided with internal teeth and the second drive wheels and the first drive wheel may each be cylindrical drive wheels provided with external teeth, wherein the second drive wheels, together with the first drive wheel and the third drive wheel, form an epicyclic transmission, and wherein the rotation axes of the drive shafts of the second drive wheels run parallel to the rotation axes of the first drive wheel and of the third drive wheel.

In order to avoid any influence on the flow resistance in the channel, the drive mechanism is preferably integrated in the housing.

In this case, it is also possible for more than two rotors to be arranged one behind the other in the flow direction of the fluid, in which case rotors which are in each case arranged one behind the other are coupled to one another in each case via a drive mechanism as described above, such that they rotate in respectively mutually opposite directions, that is to say they contrarotate.

A machine arrangement according to at least one embodiment of the invention has a continuous-flow machine according to at least one embodiment of the invention as described above and an electrical machine, wherein the electrical machine has an annular rotor which is coupled to the machine shaft and is mounted such that it can rotate about the same rotation axis as the rotors of the continuous-flow machine, and a stator which is arranged in an annular shape around the rotor. Since the electrical machine can be operated at a considerably higher speed than the rotors, the motor can be made smaller and lighter than conventional machine arrangements of the same rating. The annular configuration of the rotor of the electrical machine and its capability to rotate about the same rotation axis as that of the rotors and the machine shaft of the continuous-flow machine allows the electrical machine to be coupled directly to the machine shaft, that is to say without any intermediate transmission and therefore without any need for a transmission for power transmission between the electrical machine and the continuous-flow machine. The machine arrangement can therefore be made comparatively compact, with a relatively light weight and a relatively small space requirement. The electrical machine is in this case preferably arranged in front of or behind the rotors, in the flow direction of the fluid. This makes it possible to keep the diameter of the housing small, thus making it possible to achieve hydrodynamic advantages. However, it is also possible for the electrical machine to be arranged in an annular shape around only one of the rotors or around both rotors.

In this case, the internal diameter of the annular rotor of the electrical machine is preferably greater than or equal to the internal diameter of the annular rotors of the continuous-flow machine. The electrical machine thus has a larger internal diameter than the channel for the flow of the fluid and therefore does not represent an additional flow resistance for the fluid.

In this case, the electrical machine is advantageously integrated in the housing of the continuous-flow machine.

Since a continuous-flow machine or machine arrangement according to the invention is distinguished by high efficiency, robustness, maintenance-friendliness, a relatively light weight, a relatively small space requirement and good cavitation characteristics, it is particularly suitable for use as a propulsion device for floating and diving devices, in particular for submarines.

Furthermore, a continuous-flow machine or machine arrangement according to at least one embodiment of the invention is particularly suitable for use as a drive apparatus which can rotate horizontally and/or vertically or as a lateral-jet drive apparatus of a floating device, in particular of a marine vessel. A capability to rotate vertically can in this case be provided, for example, by means of a universally jointed suspension. Because of its relatively light weight, a drive apparatus such as this can also be designed such that it can be extended from and retracted into a marine-vessel hull, and/or can be rotated through 360°.

The continuous-flow machine or machine arrangement according to at least one embodiment of the invention is also particularly highly suitable for use in a water-jet drive apparatus for a floating device, in particular a marine vessel.

In addition, a continuous-flow machine or machine arrangement according to at least one embodiment of the invention can also be used as a pump, as a fan or as a compressor, in which case its high efficiency and its robustness are particularly important.

A continuous-flow machine or machine arrangement according to at least one embodiment of the invention can particularly advantageously also be used as a turbine, in particular in a hydroelectric power station. However, a turbine such as this can also be used for electricity generation in floating, diving or else flying devices and for this purpose, for example, be retracted into and extended from a marine-vessel hull, and can be rotated through 360°, because of its relatively light weight.

BRIEF DESCRIPTION OF THE DRAWINGS

The invention and further advantageous refinements of embodiments of the invention according to features of the dependent claims will be explained in more detail in the following text with reference to example embodiments in the figures, in which:

DETAILED DESCRIPTION OF THE EXAMPLE EMBODIMENTS

Figure 1:
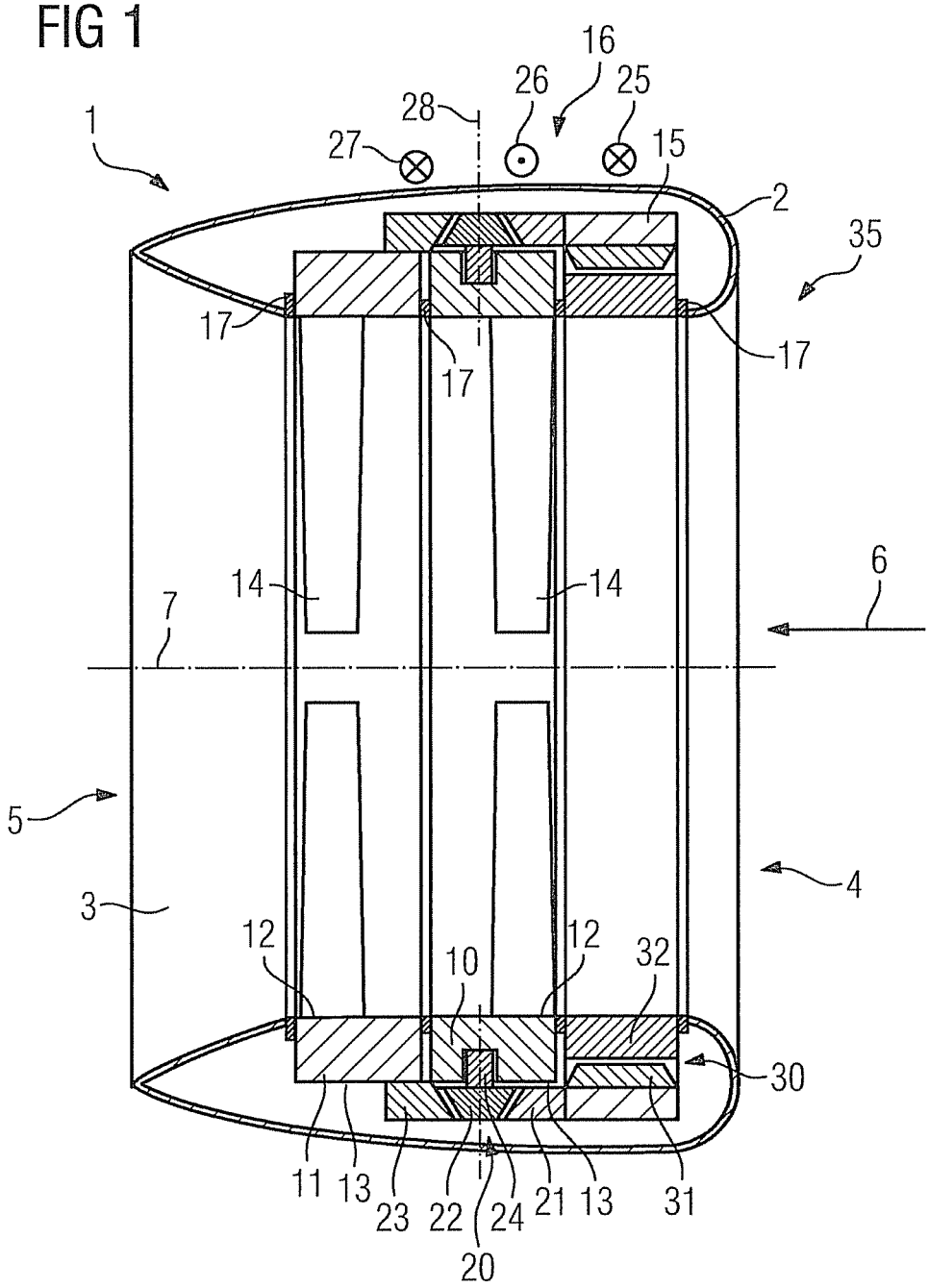
FIG. 1 shows a longitudinal section through a first embodiment of a machine arrangement according to an embodiment of the invention.

FIG. 1 shows a continuous-flow machine 1 with a housing 2 in the form of a nozzle, which forms a channel 3 for a fluid to flow from an inlet 4 to an outlet 5 in a flow direction 6. Two annular rotors 10, 11 are arranged one behind the other in the flow direction 6 of the fluid in the channel 3 and are mounted in the housing 2 such that they can rotate about a common rotation axis 7, in mutually opposite directions, by way of bearings which are not illustrated in any more detail. The rotors, 10, 11 each have an annulus inner face 12 and an annulus outer face 13. Blades or vanes 14 are in each case arranged distributed uniformly in the circumferential direction of the rotors 10, 11, on the annulus inner face 12 and rotate with the respective rotor 10, 11. The rotors 10, 11 are mounted in the housing 2 so that they can rotate axially and radially by means of bearings which are not illustrated in any more detail, for example by way of their annulus outer face 13. The blades 14 are detachably attached to the rotors 10, 11, thus allowing them to be replaced.

In this case, the annulus outer face 13 means that side of a rotor 10, 11 which is defined by the radially outer boundary surface of the rotor 10, 11, and the annulus inner face 12 means that side of a rotor 10, 11 which is defined by the radially inner boundary surface of the rotor 10, 11.

The continuous-flow machine 1 furthermore has a machine shaft 15 and a drive mechanism 16, which connects the machine shaft 15 to the two rotors 10, 11 and converts a rotary movement of the machine shaft 15 to rotary movements of the rotors 10, 11 in mutually opposite directions or vice versa. Both the machine shaft 15 and the drive mechanism 16 (which in principle represents a differential transmission) are annular. In this case, the machine shaft 15 is mounted in the housing 2 such that it can rotate about the same axis 7 as the rotors 10, 11 by means of bearings that are not illustrated in any more detail.

The drive mechanism 16 has a first drive wheel 21, a plurality of second drive wheels 22, which are arranged distributed uniformly in the circumferential direction of the annular drive mechanism 16 and each have a drive shaft 24 which can rotate about a rotation axis 28, and a third drive wheel 23. In this case, the first drive wheel 21 is connected to the machine shaft 15 such that they rotate together for this purpose, and can in this case rotate about the same rotation axis 7 as the rotors 10, 11 and the machine shaft 15. The third drive wheel 23 is likewise connected to the rotor 11 such that they rotate together for this purpose and can likewise rotate about the same rotation axis 7 as the rotors 10, 11 and the machine shaft 15. The drive shafts 24 of the second drive wheels 22 are mounted in the rotor 10 such that they can rotate. The first drive wheel 21, a respective second drive wheel 22, and the third drive wheel 23 are therefore arranged one behind the other in the flow direction 6 of the fluid through the channel 3. For torque transmission, the second drive wheels 22 are each coupled to the first drive wheel 21 and to the third drive wheel 23. The drive mechanism 16 and the rotors 10, 11 are in this case sealed from the channel 3 by seals 17.

In the embodiment of the invention illustrated in FIG. 1, for coupling of the drive wheels 21, 22, 23, the first drive wheel 21, the second drive wheels 22 and the third drive wheel 23 are each in the form of a bevel gear which is provided with a tooth system, wherein the second drive wheels 22 in each case form a bevel gear transmission with the first drive wheel 21 and with the third drive wheel 23, in which the drive wheel 22 forms the pinion, and the drive wheels 21 and 23 each form the spur bevel gear. The drive shafts 24 of the second drive wheels 22 are in this case mounted such that they can rotate in the annulus outer face 13 of the rotor 10, and their rotation axes 28 are at right-angles to the rotation axis 7 of the first drive wheel 21 and of the third drive wheel 23. In this case, both the tooth system on the first drive wheel 21 and the tooth system on the third drive wheel 23 engage in the tooth systems on the second drive wheels 22.

In principle, of course, torque can also be transmitted between the drive wheels by a friction connection, rather than by a tooth system. Furthermore, it is also possible for the first drive wheel 21 and the machine shaft 15 not to form separate components, but a single component, that is to say for the tooth system on the first drive wheel 21 to be applied directly to the machine shaft 15. In a corresponding manner, the second rotor 11, and the third drive wheel 23 can also form a single component, that is to say the tooth system of the third drive wheel 23 can be applied directly to the rotor 11.

The drive mechanism 16 acts as a differential transmission. On the one hand, it can be used to transmit power from the machine shaft 15 to the rotors 10, 11. A rotary movement of the machine shaft 15 is then converted by the drive mechanism 16 to rotary movements of the rotors 10, 11 in mutually opposite directions, that is to say contrarotation. For example, if the machine shaft 15 is rotating in the direction of the arrow 25, then it moves the first rotor 10 in the opposite direction to this, as symbolized by the arrow 26 and once again moves the second rotor 11 in the opposite direction to the rotor 10, that is to say in the direction of the machine shaft 15, as symbolized by the arrow 27.

However, the drive mechanism 16 can also be used to transmit power from the rotors 10, 11 to the machine shaft 15. Rotary movements of the rotors 10, 11 in opposite directions are then converted by the drive mechanism 16 to a rotary movement of the machine shaft 15.

In both cases, the rotation speed (or angular velocity) of the rotors 10, 11 is significantly less than the rotation speed (or angular velocity) of the machine shaft 15, depending on the chosen transmission ratio.

The continuous-flow machine 1 can therefore be used both as a process machine, which carries out work on a fluid flowing through the channel 3, or as a power machine, which is driven by a fluid flowing in the channel 3 and emits mechanical power on the machine shaft 15.

The second rotor 11 allows the lossy swirl of the outlet flow from the first rotor 10, that is to say the flow components of the fluid which differ from the flow direction 6 (for example, radial or circular flow components) to be at least partially redirected to the main flow direction, and therefore converted to thrust or to a torque which can be absorbed by a downstream rotor. The second rotor 11 therefore provides at least partial torque compensation. Mechanical torque compensation such as this makes it possible to achieve a particularly high efficiency from the continuous-flow machine.

Since the conversion of rotation speed to torque takes place only shortly before the power-transmitting component from the mechanism to the fluid, the entire continuous-flow machine 1 can be designed to be relatively light in weight.

In one particularly advantageous machine arrangement 35, the continuous-flow machine 1 is coupled to an electrical machine 30. The electrical machine 30 has an annular rotor 31 with an exciter system which is not illustrated in any more detail (for example a winding arrangement or an arrangement of permanent magnets), which is connected to the machine shaft 15 such that they rotate together and is mounted in the housing 2 by means of bearings, which are not illustrated in any more detail, such that it can rotate about the same rotation axis 7 as the rotors 10, 11 of the continuous-flow machine 1. The machine shaft 15 and the rotor 31 of the electrical machine 30 can in this case also be in the form of a single physical unit, that is to say the rotor-side exciter system for the electrical machine 30 can also be arranged directly on the machine shaft 15.

The electrical machine 30 also has an annular stator 32, which is integrated in the housing 2 and is connected to the housing 2 such that they rotate together. The stator 32 likewise has an exciter system, which is not illustrated in any more detail but which is electromagnetically interactive with the exciter system of the rotor 31. In this case, the stator 32 is arranged in front of the rotor 31 in the radial direction with respect to the rotation axis 7. The electrical machine 30 is therefore an externally running machine, that is to say the rotor 31 is arranged in an annular shape around the stator 32. The electrical machine 30 is in this case arranged in front of the first rotor 10 in the flow direction 6 of the fluid.

On the one hand, the electrical machine 30 can be used as a direct drive, without transmission, for driving the machine shaft 15 and therefore the rotors 10, 11. However, the electrical machine 30 can also be used as a generator which is driven by the rotors 10, 11 and the machine shaft 15.

Alternatively, of course, the continuous-flow machine may also be driven via other means with which a person skilled in the art will be familiar (for example, via a transmission), by way of an electrical machine or an internal combustion engine. In this case, the continuous-flow machine need not necessarily be annular but may also have a solid shaft with a rotation axis which is parallel to or at an angle to the rotation axis 7 of the rotors 10, 11.

The machine arrangement 35 illustrated in FIG. 1 has particularly low resistance for the fluid flowing through the channel 3. For this purpose, the continuous-flow machine 1 has no component (for example a central shaft) running along the rotation axis 7 of the rotors 10, 11 and through them. Furthermore, the machine shaft 15, the stator 31 and the rotor 32 of the electrical machine 30 are integrated in the housing 2 of the continuous-flow machine 1.

In addition, the annular rotors 10, 11 are designed such that the diameter of the annulus inner face 12 (possibly including the thickness of a seal 17 arranged on the annulus inner face 12) corresponds to the diameter of the channel 3 immediately in front of the respective rotor 10, 11. The annular rotor 10, 11 is for this purpose arranged recessed in the housing 2 or its annulus inner face 12 (possibly including a seal 17 arranged on the annulus inner face 12) forms the outer boundary surface of the channel 3 in the area of the rotor 10, 11, in which case this outer boundary surface is aligned with the adjacent outer boundary surface, which is formed by the housing 2. The annular rotors 10, 11 themselves therefore do not represent any flow resistance for the fluid.

The internal diameter of the annular rotor 31 of the electrical machine 30 is greater than the internal diameter of the annular rotors 10, 11 of the continuous-flow machine 1. The internal diameter of the annular stator 32 of the electrical machine 30 is (including the thickness of a seal 17 which may be arranged on the annulus inner face 12) equal to the diameter of the channel 3 in the area of the electrical machine 30 and therefore forms the outer boundary surface of the channel 3 in the area of the electrical machine 1, in which case this outer boundary surface is aligned with the adjacent outer boundary surface which is formed by the housing 2 and the rotors 10, 11. The electrical machine 30 therefore also does not represent any flow resistance for the fluid.

Figure 2:
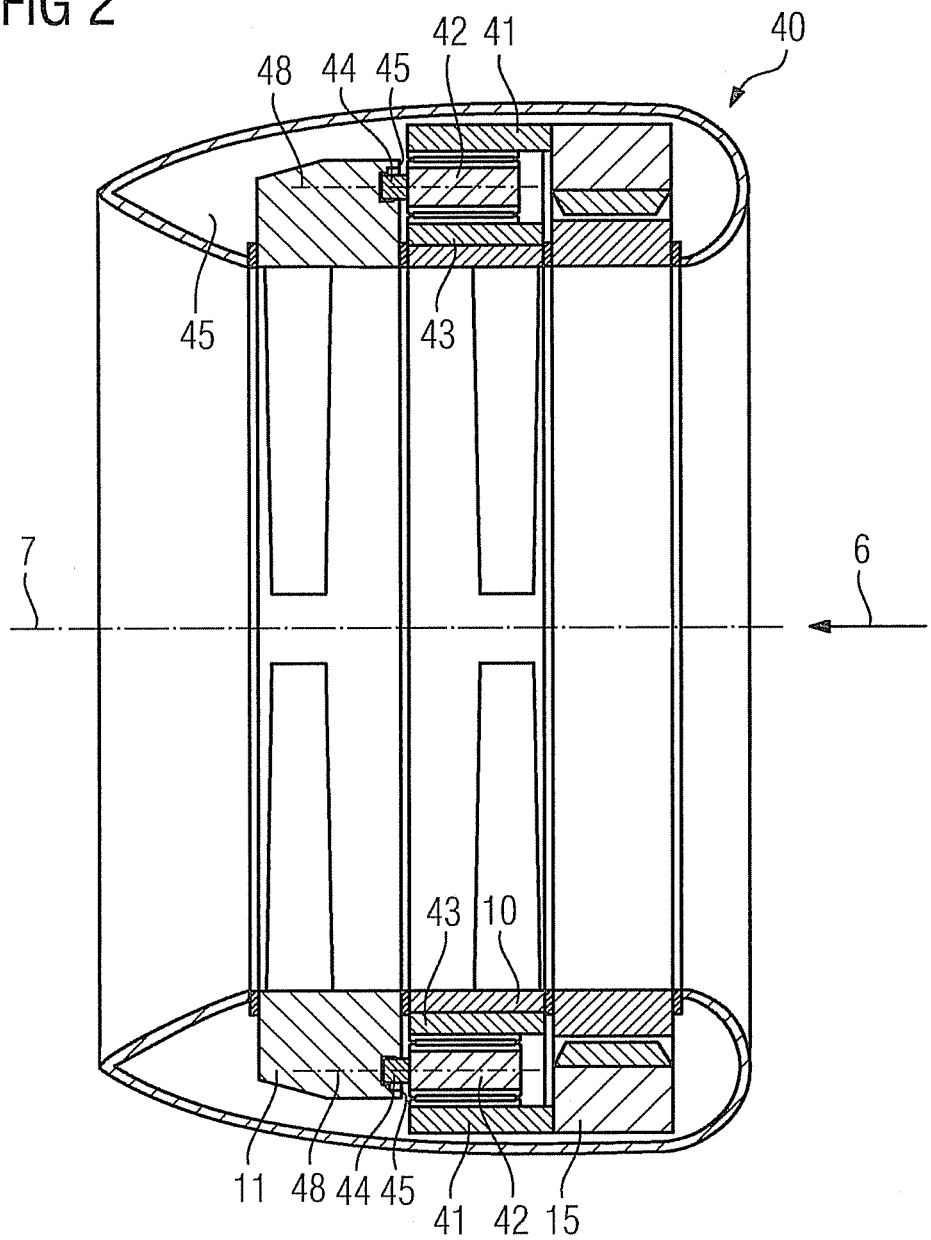
FIG. 2 shows a longitudinal section through a second embodiment of a machine arrangement according to an embodiment of the invention.

A continuous-flow machine 40 as illustrated in FIG. 2 differs from the continuous-flow machine 1 illustrated in FIG. 1 in that the first drive wheel 41 is a cylindrical drive wheel provided with internal teeth and the second drive wheels 42 and the third drive wheel 43 are each cylindrical drive wheels provided with external teeth. The second drive wheels 42 in this case, together with the first drive wheel 41 and the third drive wheel 43, form an epicyclic transmission with a hollow wheel, a sun wheel and a plurality of planet wheels arranged between them, in which case the first drive wheel 41 represents the hollow wheel, the third drive wheel 43 the sun wheel, and the second drive wheels 42 the planet wheels. In this case, both the tooth system on the first drive wheel 41 and the tooth system on the third drive wheel 43 engage in the tooth systems on the second drive wheels 42.

The drive shafts 44 of the second drive wheels 42, are in this case arranged on the end face 45 of the rotor 11, facing the rotor 10, and have rotation axes 48 which run parallel to the rotation axis 7 of the first drive wheel 41 and of the third drive wheel 43. The end face of a rotor in this case means the outer boundary surface in the axial direction, that is to say in the direction of its rotation axis 7.

In principle, torque can, of course, also be transmitted between the drive wheels 41, 42, 43 via a friction connection rather than via a tooth system.

Furthermore, it is also possible for the first drive wheel 41 and the machine shaft 15 not to be separate components, but to be a single integrated component, that is to say for the tooth system on the first drive wheel 41 to be applied directly to the machine shaft 15. Correspondingly, the rotor 10 and the third drive wheel 43 also form a single integrated component, that is to say the tooth system on the third drive wheel 43 is applied directly to the rotor 10.

Figure 3:
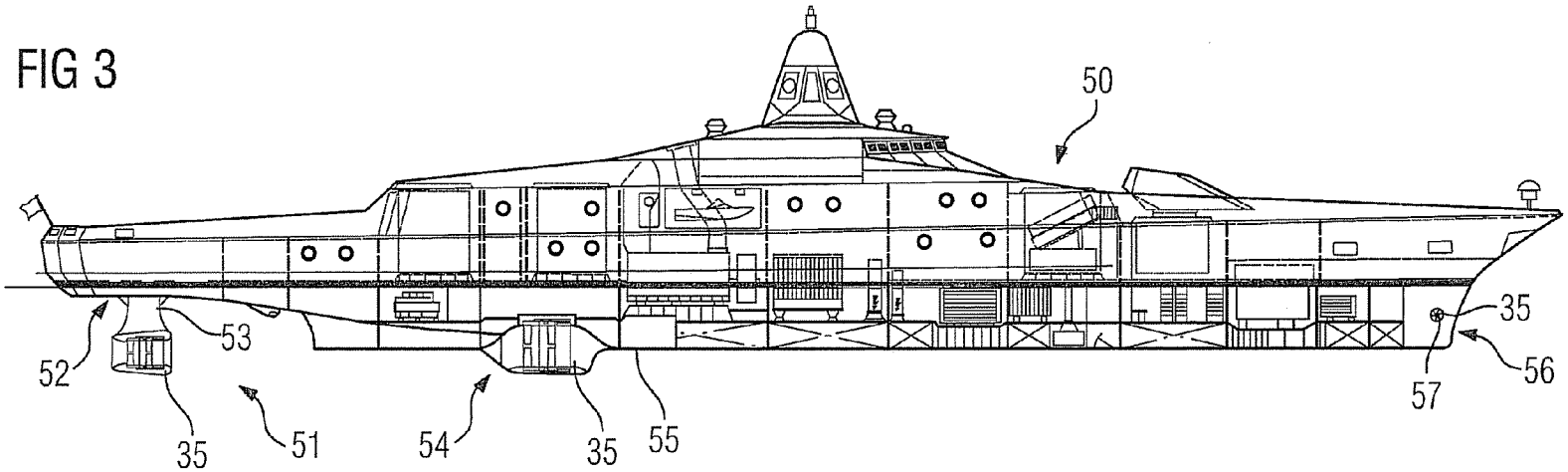
FIG. 3 shows a use of the continuous-flow machines according to an embodiment of the invention for a surface vessel.

FIG. 3 shows a longitudinal section illustration through a marine vessel 50 of the "Corvette" type, in which a first machine arrangement 35 including a continuous-flow machine 1 and an electrical machine 30 as shown in FIG. 1 or FIG. 2 with a relatively high rating is used as a drive apparatus 51, which can rotate horizontally, at the stern 52 of the marine vessel. The machine arrangement 35 is in this case attached to a shaft 53 such that they rotate together, which shaft 53 is mounted in the marine vessel 50 such that it can rotate horizontally.

For certain types of marine vessel, a drive apparatus which can rotate vertically can also be arranged with the machine arrangement 35 at the stern 52 of the marine vessel 50 instead of using a drive apparatus 51 which can rotate horizontally.

In addition, a second machine arrangement 35 as shown in FIG. 1 or 2 of medium power is used in a water jet drive apparatus 54, which is arranged at the bottom of the marine vessel 55.

Furthermore, a machine arrangement 35 as shown in FIG. 1 with a relatively low rating is used in a lateral jet thruster drive apparatus 57 which is arranged in the bow 56 of the marine vessel 50.

On board the marine vessel 50, there are one or more generators, preferably diesel generators, or other electrical power sources or energy stores, for example batteries and/or fuel cells, which supply electricity to the electrical machines which are operated as electric motors in the machine arrangements 35.

In the described embodiment, the drive for the "Corvette" type of marine vessel described, with its type displacement of about 2000 tonnes and an assumed maximum speed of more than 35 knots consists of two drive apparatuses 51 which can rotate horizontally, and two water jet drive apparatuses 54.

In this case, the electrical machines 35 can also be operated as generators for energy recovery.

Figure 4:
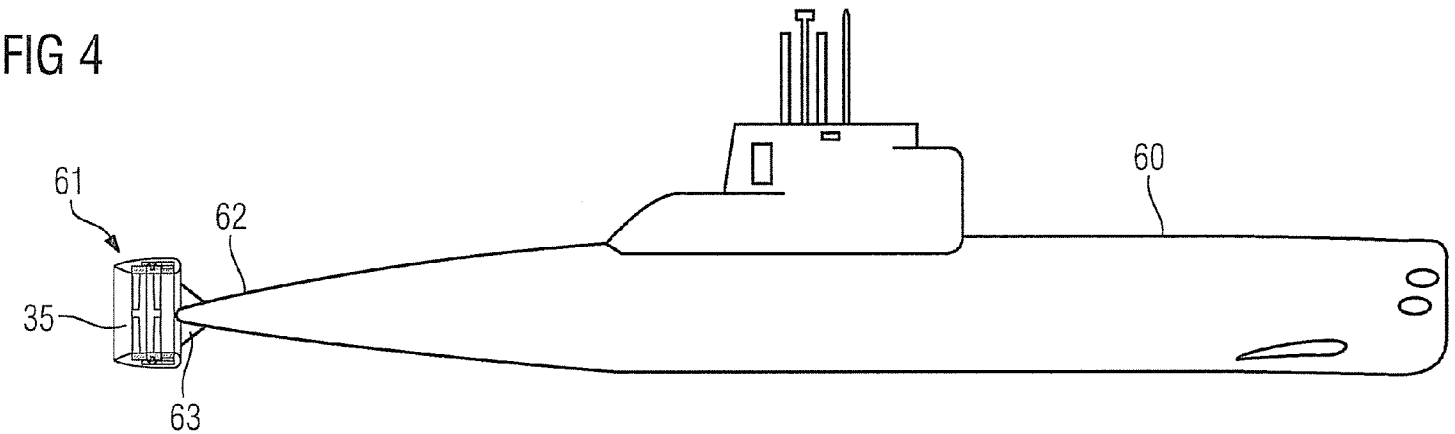
FIG. 4 shows a use of the continuous-flow machine according to an embodiment of the invention for a submarine.

FIG. 4 shows a submarine 60 in which a machine arrangement 35 as shown in FIG. 1 or 2 is used as a propulsion device 61 at the stern 62 of the submarine 60. The machine arrangement 35 is in this case attached to the stern 62 of the marine vessel by way of a holder 63. Since the rotor blades in the machine arrangement 35 are surrounded by the housing, the drive is distinguished by producing particularly little noise, which is often important, particularly for submarines. The electrical power supply to the electrical machine in the machine arrangement 35 can in this case be provided via the holder 63.

In this case as well there are one or more generators, which are not illustrated in any more detail, on board the submarine 60, preferably diesel generators, or other electrical power sources or energy stores, such as batteries and/or fuel cells, which supply electrical power to the electrical machine, which is operated as an electric motor, in the machine arrangement 35.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A continuous-flow machine, comprising:

at least two rotors, mounted to be rotatable about a rotation axis in mutually opposite directions and on which blades or vanes are arranged, a machine shaft, mounted to be rotatable;

a drive mechanism, to connect the machine shaft to the at least two rotors and to convert a rotary movement of the machine shaft to rotary movements of the at least two rotors in mutually opposite directions, or vice versa; and a housing which forms a channel for a flow of a fluid, wherein the at least two rotors are arranged one behind the other in the channel in a flow direction of the fluid, the machine shaft and the at least two rotors are annular and are mounted to be rotatable in the housing, and the at least two annular rotors each include an annulus inner face and an annulus outer face, and wherein the blades or vanes are arranged on the annulus inner face, wherein the drive mechanism includes a first drive wheel, a plurality of second drive wheels being arranged distributed in the circumferential direction of the annular drive mechanism and each including a drive shaft, rotatable about a rotation axis and a third drive wheel, the first drive wheel is connected to the machine shaft such that they rotate together, the third drive wheel is connected to a first of the at least two rotors such that they rotate together, and the drive shafts of the second drive wheels are mounted such that they can rotate in the other of the at least two rotors, and wherein the second drive wheels are coupled to the first drive wheel and to the third drive wheel.

2. The continuous-flow machine as claimed in claim 1, wherein the machine has no component which runs along the rotation axis of the at least two rotors and through the at least two rotors.

3. The continuous-flow machine as claimed in claim 1, wherein the drive mechanism is annular.

4. The continuous-flow machine as claimed in claim 1, wherein the first drive wheel, the second drive wheels and the third drive wheel are each in the form of a bevel gear which is provided with a tooth system, wherein the second drive wheels, both with the first drive wheel and with the third drive wheel, each form a bevel-gear transmission, and wherein the rotation axes of the drive shafts of the second drive wheels are at right angles to the rotation axes of the first drive wheel and of the third drive wheel.

5. The continuous-flow machine as claimed in claim 1, wherein the first drive wheel is a cylindrical drive wheel provided with internal teeth and the second drive wheels and the third drive wheel are each cylindrical drive wheels provided with external teeth, wherein the second drive wheels, together with the first drive wheel and the third drive wheel in each case form an epicyclic transmission, and wherein the rotation axes of the drive shafts of the second drive wheels run parallel to the rotation axes of the first drive wheel and of the third drive wheel.

6. The continuous-flow machine as claimed in claim 1, wherein the third drive wheel is a cylindrical drive wheel provided with internal teeth and the second drive wheels and the first drive wheel are each cylindrical drive wheels provided with external teeth, wherein the second drive wheels, together with the first drive wheel and the third drive wheel, form an epicyclic transmission, and wherein the rotation axes of the drive shafts of the second drive wheels run parallel to the rotation axes of the first drive wheel and of the third drive wheel.

7. The continuous-flow machine as claimed in claim 1, wherein the drive mechanism is integrated in the housing.

8. A machine arrangement, comprising:

a continuous-flow machine as claimed in claim 1; and an electrical machine including an annular rotor, coupled to the machine shaft and mounted to be rotatable about the same rotation axis as the at least two rotors of the continuous-flow machine, and a stator arranged in an annular shape around the rotor.

9. The machine arrangement as claimed in claim 8, wherein an internal diameter of the annular rotor of the electrical machine is greater than or equal to an internal diameter of the annular rotors of the continuous-flow machine.

10. The machine arrangement as claimed in claim 8, wherein the electrical machine is integrated in the housing of the continuous-flow machine.

11. A method comprising:

propelling at least one of a floating device and a diving device with a propulsion device, wherein the propulsion device includes the continuous-flow machine as claimed in claim 1.

12. A method comprising:

driving a floating device with at least one of a rotatable drive apparatus and a lateral-jet thruster, wherein the at least one of the rotatable drive apparatus and the lateral-jet thruster includes the continuous-flow machine as claimed in claim 1.

13. A method comprising:

driving a floating device with a water-jet drive apparatus that includes the continuous-flow machine as claimed in claim 1.

14. A method comprising:

operating at least one of a pump, a fan and a compressor, wherein the at least one of a pump, a fan and a compressor includes the continuous-flow machine as claimed in claim 1.

15. A method comprising:

generating electricity, in at least one of a floating or diving device, or in a hydroelectric power station, with a turbine, wherein the turbine includes the continuous-flow machine as claimed in claim 1.

16. The machine arrangement as claimed in claim 9, wherein the electrical machine is integrated in the housing of the continuous-flow machine.

17. A method comprising:

propelling at least one of a floating device and a diving device with a propulsion device, wherein the propulsion device includes the machine arrangement as claimed in claim 8.

18. A method comprising:

driving a floating device with at least one of a rotatable drive apparatus and a lateral jet thruster, wherein the at least one of the rotatable drive apparatus and the lateral jet thruster includes the machine arrangement as claimed in claim 8.

19. A method comprising:

driving a floating device with a water-jet drive apparatus that includes the machine arrangement as claimed in claim 8.

20. A method comprising:

operating at least one of a pump, a fan and a compressor, wherein the at least one of the pump, a fan and a compressor includes the machine arrangement as claimed in claim 8.

21. A method comprising:

generating electricity, in at least one of a floating device and a driving device, with a turbine, wherein the turbine includes the machine arrangement as claimed in claim 8.

22. The continuous-flow machine as claimed in claim 2, wherein the drive mechanism is annular.

* * * * *